United States Patent [19]

Chachin et al.

[11] 4,027,515

[45] June 7, 1977

[54] DEVICE FOR ELECTRICAL DISCHARGE FORMING

[76] Inventors: Viktor Nikolaevich Chachin, bulvar Lunacharskogo, 8, kv. 21; Gennady Nikolaevich Zdor, ulitsa V.Khoruzhei, 19, kv. 14; Alexandr Julyanovich Zhuravsky, Partizansky prospekt, 28, korpus 2, kv. 135; Elena Yakovlevna Golovkina, ulitsa Kakhovskaya, 37, kv. 42; Vladimir Leontievich Shaduya, ulitsa Pervomaiskaya, 8, kv. 7, all of Minsk, U.S.S.R.

[22] Filed: May 3, 1976

[21] Appl. No.: 682,471

[30] Foreign Application Priority Data

May 11, 1975 U.S.S.R. ..... 2132196

[52] U.S. Cl. ..... 72/56; 72/DIG. 25; 72/DIG. 24

[51] Int. Cl.² ..... B21D 26/02

[58] Field of Search ..... 72/56, 60

[56] References Cited

UNITED STATES PATENTS

| | | | |
|---|---|---|---|
| 3,195,334 | 7/1965 | Filler | 72/56 |
| 3,240,079 | 1/1969 | Erlandson | 72/56 |
| 3,273,365 | 9/1966 | Felts | 72/56 |
| 3,383,889 | 5/1968 | Amini et al. | 72/56 |
| 3,643,482 | 2/1972 | Hertel | 72/56 |
| 3,675,453 | 7/1975 | Morich | 72/56 |
| 3,742,746 | 7/1973 | Erlandson | 72/56 |

*Primary Examiner*—Leon Gilden
*Attorney, Agent, or Firm*—Lackenbach, Lilling & Siegel

[57] ABSTRACT

A device for electrical discharge forming comprises an explosion chamber and a work-holding die pressed against the explosion chamber in the course of forming. The wall of the explosion chamber has at least two channels with a cross section gradually changing over their length. The channels are arranged at an acute angle to the geometrical axis of the explosion chamber so that their wider ends are directed into the explosion chamber whereas the narrower ends are directed to the die near the zone of the work. As a result, part of the impact wave created by the explosion passes through the channels and acts on the face surfaces of the work thus ensuring more intensive and uniform shaping of the work. This device is capable of producing complex-shaped parts of a high quality from hard-to-work materials.

3 Claims, 2 Drawing Figures

DEVICE FOR ELECTRICAL DISCHARGE FORMING

Figure 1:
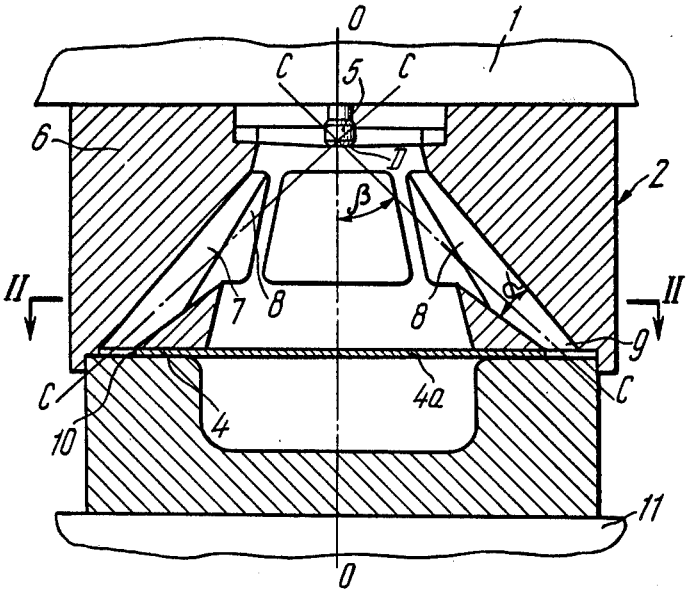

The present invention relates to high-speed shaping of materials and more particularly it relates to devices for electrical discharge forming.

The present invention can be used to advantage for electrical discharge forming of articles with a complex shape, made from hard-to-work materials.

The device according to the present invention can be successfully used for deep drawing operations.

This invention can be employed in machine-building, instrument building, aircraft and other industries.

Widely known in the prior art is a device for electrical discharge forming which comprises a fixed plate and an explosion chamber mounted on said plate. Another plate which is capable of moving towards and away from the explosion chamber is mounted on a work-holding die. In the course of forming the explosion chamber is filled with a working fluid intended to apply the energy of the explosion to the work. Accommodated inside the explosion chamber is an electrode, the function of the other electrode being fulfilled by the explosion chamber wall.

For electrical discharge forming the die with the work is pressed tightly against the explosion chamber.

The process of electrical discharge forming is effected by the explosion whose energy is transmitted by the working fluid.

A disadvantage of the above-described device lies in that the material of the work becomes considerably thinner in its most heavily loaded middle part which leads frequently to inferior quality of parts and even to their failure in the course of forming.

An object of the present invention is eliminating the aforesaid disadvantage.

The main object of the invention is to provide a device for electrical discharge forming wherein the explosion chamber would be so designed as to allow distribution of the energy of the impact wave so that part of this energy would be conveyed to the face surfaces of the work thus ensuring more intensive and uniform forming thereof.

This object is accomplished by providing a device for electrical discharge forming comprising an explosion chamber and a work-holding die pressed against the explosion chamber in the course of forming, wherein, according to the invention, the wall of the explosion chamber has at least two channels whose cross section changes gradually over their length and which are set at an acute angle to the geometrical axis of the explosion chamber so that the wider ends of these channels are directed into the explosion chamber and are in essence equispaced around its perimeter and so that the narrower ends are directed to the die and are in essence equispaced around its perimeter near the zone of the work so that the impact wave created by the explosion passes through the channels and acts on the face surfaces of the work in the course of its shaping.

Owing to such a layout, part of the energy of the impact wave in the course of electrical discharge forming is directed to the face surfaces of the work in order to shape them.

It is practicable that the axial section of each channel should have the shape of a bell-mouth whose sides are set at an angle of 1° – 15° to each other.

Such an arrangement of the channels increases the pressure in the narrow section of the bell-mouth which directly adjoins the face surface of the work.

It is recommended that the channels in the explosion chamber wall should be arranged in such a manner that their geometrical axes would cross the explosion epicenter.

This arrangement ensures free propagation of the impact wave through said channels.

The use of the present invention in electrical discharge forming allows the impact wave to act not only on the middle part of the work but also on its face surfaces through the channels in the explosion chamber wall.

Further, the bell-mouth channels with an angle of 1° – 15° between the bell-mouth sides ensure an additional increase of pressure at the face surface of the work.

Thus, the device for electrical discharge forming according to the present invention makes it possible to manufacture complex-shaped parts of a sufficiently high quality from hard-to-work materials.

Figure 2:
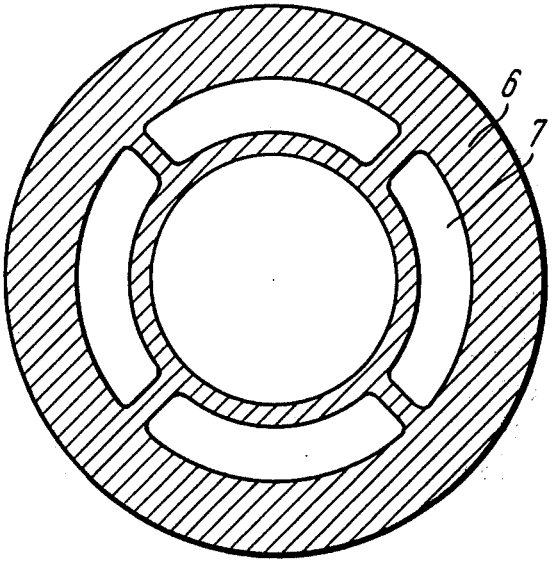

Now the invention will be described in detail by way of example with reference to the accompanying drawings in which:

FIG. 1 is a schematic longitudinal section through the device for electrical discharge forming according to the invention; and FIG. 2 is a cross sectional view taken along the line II — II in FIG. 1.

The device for electrical discharge forming according to the invention comprises a fixed plate 1 (FIG. 1) which is mounted on an explosion chamber 2. The device also comprises a die 3 for holding the work 4, said die being pressed against the explosion chamber 2 in the course of forming. Accommodated inside the explosion chamber 2 is an electrode 5, the function of the other electrode 6 being fulfilled by the wall of the explosion chamber 2, said wall being also designated by FIG. 6 (FIGS. 1, 2). The explosion chamber 2 is filled with a working fluid (in the given case with water) which conveys the energy of explosion to the work 4. The wall 6 of the explosion chamber 2 is provided with channels 7 whose cross section changes gradually over their length. The channels 7 are set at an acute angle $\beta$ (FIG. 1) to the geometrical axis O — O of the explosion chamber. The wider ends 8 of the channels 7 are directed into the explosion chamber 2, and are equispaced around its perimeter. The other, narrower ends 9 of the channels 7 are directed to the die, and are equispaced around the perimeter of the explosion chamber 2 and opening on the face surface 10 of the work 4.

The axial section of the channels 7 has the shape of a bell-mouth whose sides are set at an angle ($\alpha$) ranging from 1° to 15°. This shape of the channels 7 increases the pressure in their narrow part directly adjoining the face surface 10 of the work 4.

The channels 7 are arranged so that their geometrical axes C — C cross the explosion epicenter D.

Owing to such an arrangement, the impact wave created by the explosion is free to enter the channels.

The die 3 with the work 4 is secured on a movable plate 11 which is kinematically linked with a mechanism (not shown in the drawing) for moving the die 3 and for pressing it against the explosion chamber 2.

The device for electrical discharge forming functions as follows.

In the initial position the movable plate 11 with the die 3 secured on it occupies the downmost position (not shown in the drawing). The operator puts the work 4 on the die 3 and turns on the mechanism (not shown in the drawing) for lifting the die 3 and for pressing it against the explosion chamber 2.

The movable plate 11 with the die 3 moves the work 4 until it is pressed against the explosion chamber 2.

Now the explosion chamber 2 is filled with water and a high voltage is delivered to the electrode 5. This causes a high-voltage discharge which creates impact waves. A part of the energy of the impact wave acts on the middle portion 4*a* (FIG. 1) of the work 4 while other parts are directed through the channels 7 to the face surface 10 of the work 4, the shape of each channel 7 increasing the pressure at its narrower end 9 above the pressure in the explosion chamber. The material of the work 4 fills the die 3, being additionally pressed from the side of its face surface 10.

Then the movable plate 11 with the die 3 and the work is moved down to the initial positions; simultaneously, the water is discharged from the explosion chamber 2. The operator takes out the formed article and the device is ready for the next forming cycle.

An experimental specimen of the device for electrical discharge forming according to the invention has passed all-round tests which proved its high operational efficiency.

The parts manufactured by this device feature a sufficiently high quality.

The device according to the invention is capable of producing parts whose material is drawn considerably stronger than that of the parts manufactured by the known devices.

We claim:

1. A device for electrical discharge forming comprising: a fixed plate; an explosion chamber mounted on said fixed plate; an appliance for creating an explosion; a work-holding die pressed against said explosion chamber in the process of forming; an appliance for pressing said die against said explosion chamber; at least two channels whose cross section changes gradually over their length, said channels being made in the wall of said explosion chamber; said channels arranged at an acute angle to the geometrical axis of said explosion chamber so that their wider ends are directed into said explosion chamber and are in essence equispaced around its perimeter and so that the other, narrower ends of said channels are directed to said die and are in essence equispaced around its perimeter near the zone of the work so that the impact wave created by the explosion passes through said channels and acts on the face surfaces of the work in the course of its shaping.

2. A device according to claim 1 wherein an axial section of each of said channels has the shape of a bell-mouth with an angle of 1° – 15° between its sides.

3. A device according to claim 1 wherein said channels in said wall of said explosion chamber are arranged so that their geometrical axes cross the explosion epicenter.

* * * * *